US009391405B1

(12) United States Patent
Wu

(10) Patent No.: US 9,391,405 B1
(45) Date of Patent: Jul. 12, 2016

(54) PIN STRUCTURE OF MODULAR JACK

(71) Applicant: HSING CHAU INDUSTRIAL CO., LTD., Taipei (TW)

(72) Inventor: Kei-Wei Wu, Taipei (TW)

(73) Assignee: HSING CHAU INDUSTRIAL CO., LTD. (TW)

( * ) Notice: Subject to any disclaimer, the term of this patent is extended or adjusted under 35 U.S.C. 154(b) by 0 days.

(21) Appl. No.: 14/844,085

(22) Filed: Sep. 3, 2015

(51) Int. Cl.

| | |
|---|---|
| ***H01R 24/00*** | (2011.01) |
| ***H01R 13/6466*** | (2011.01) |
| ***H01R 24/64*** | (2011.01) |
| ***H01F 38/14*** | (2006.01) |

(52) U.S. Cl.
CPC ..... *H01R 13/6466* (2013.01); *H01F 38/14* (2013.01); *H01R 24/64* (2013.01); *H01F 2038/146* (2013.01)

(58) Field of Classification Search
CPC ..... H01R 13/6464; H01R 13/6466; H01R 13/6461; H01R 23/005
USPC ..... 439/676, 941
See application file for complete search history.

(56) References Cited

U.S. PATENT DOCUMENTS

| | | | | |
|---|---|---|---|---|
| 6,443,777 | B1 * | 9/2002 | McCurdy | H01R 13/6461 439/676 |
| 7,201,618 | B2 * | 4/2007 | Ellis | H01R 13/6477 439/676 |
| 7,229,309 | B2 * | 6/2007 | Carroll | H01R 13/6463 439/418 |
| 7,481,678 | B2 * | 1/2009 | Aekins | H01R 13/7033 439/620.11 |
| 7,604,515 | B2 * | 10/2009 | Siemon | H01R 13/6463 439/676 |
| 8,197,286 | B2 * | 6/2012 | Larsen | H01R 4/2429 439/620.21 |
| 2008/0311797 | A1 * | 12/2008 | Aekins | H01R 13/41 439/676 |
| 2010/0151740 | A1 * | 6/2010 | Hogue | H01R 9/031 439/638 |
| 2011/0053430 | A1 * | 3/2011 | Bopp | H01R 13/6658 439/676 |
| 2014/0080360 | A1 * | 3/2014 | Tai | H01R 13/6474 439/620.23 |

* cited by examiner

*Primary Examiner* — Abdullah Riyami
*Assistant Examiner* — Thang Nguyen
(74) *Attorney, Agent, or Firm* — Schmeiser, Olsen & Watts, LLP

(57) ABSTRACT

A pin structure of a modular jack includes the first through eighth resilient pins. The resilient pins have bent electrically fixing portions fixed to a circuit board and bent electrical contact portions. Vertices of the bent electrical contact portions point away from the circuit board. The first, second, fourth and sixth resilient pins have the bent electrically fixing portions lying on a first straight line. The third, fifth, seventh and eighth resilient pins have the bent electrically fixing portions lying on a second straight line. The vertices of the bent electrical contact portions lie on a third straight line. The first through third straight lines are parallel to and oppose the insertion side of the circuit board.

3 Claims, 14 Drawing Sheets

PIN STRUCTURE OF MODULAR JACK

FIELD OF THE INVENTION

The present invention relates to pin structures of a modular jack and more particularly to a pin structure of a modular jack to reduce crosstalk and loss so as to meet stricter requirements.

BACKGROUND OF THE INVENTION

Over the past few years, advances in network transmission have facilitated an explosive increase in data transmission rate. And in data transmission nowadays, it is advantageous to transmit signals over a pair of conductors, which is recognized as "differential pair", rather than over a single conductor. The way it works is having signals transmitted on each conductor with equal magnitudes but opposite phases. Data transmission using differential pair technique is acknowledged as balanced transmission. Comparing to single-ended transmission, differential signals are generally more immune to the effects of external electrical noises. And usually, the two conductors of a differential pair for network transmission are twisted in a precisely managed ratio. The well-controlled twists increase the noise immunity and reduce the bit error rate (BER) of data transmission.

Considering the ascendency of differential copper cabling in the market today, the standards have been continuously focusing on keeping the same user-friendly RJ-45 connector interface allowing for backward compatibility. The RJ-45 connector was originally adopted as a standard specified interface of network connectors back in 1991 when the data transmission speed was set to 10 Mbs/sec with operating frequency up to 16 MHz only, which was referred to as Category 3.

Now, the most up-to-date Augmented Category 6 standards (e.g. TIA-568-C.2 & ISO-11801 ed.2) compliance with IEEE 802.3an 10GBASE-T protocol is set to use RJ-45 connector remains. However, the transmission speed is specified 1,000 times higher (10 Gbs/sec) with operating frequency up to 500 MHz. Using RJ-45 connectors at high frequencies leads to extreme challenges due to the crosstalks and losses come along with the fixed RJ-45 geometry.

When it comes to qualification of transmission capability of a RJ-45 modular jack or patch panel connecting hardware (hereinafter referred to as "jack"), there are two types of measurements need to be taken into consideration. They are transmission (crosstalk) and reflection (loss). Among the transmission requirements specified by standard, near end crosstalk (NEXT), far end crosstalk (FEXT), and insertion loss (IL) are the key parameters which have to be satisfied while return loss (RL) is the parameter determined with a reflection measurement.

Energy from one signal conductor may be partially introduced to couple into adjacent signal conductor by the electric field generated between two signal conductors and the magnetic field generated owing to the variation of electric field simultaneously. This capacitive and inductive coupling represents the phenomenon of crosstalk. Crosstalks are the unwanted signals electromagnetically coupled from another conductor unintentionally. Therefore, those distortional signals usually affect the signals that are supposed to run through the disturbed differential signal path.

Crosstalk comes from the legacy of RJ-45 modular plug (hereinafter referred to as "plug"), which has a significant amount of crosstalk coupling (NEXT and FEXT) when being mated with a jack. The standard RJ-45 jack housing utilizes a straightforward design with a spaced interval 1.016 mm of resilient pins from 1 to 8 in a relative uniform and parallel alignment (FIG. 1).

Among the wire pairs that are crimped with contact blades proximally inside the plug, capacitive and inductive couplings are parasitized therein. The contact blades have a large area to react themselves as a transmitting and receiving antenna. And the split of wire pair positioned in contact 3 and contact 6 worsens all the pair combinations by coupling adjacent three other pairs. Among all the signal interference, the near end coupling between Pair 1 and Pair 3 is the most severe one due to the Pair 3 is diverged and physically enfold the Pair 1 (FIG. 2). Therefore, when a RJ-45 jack is connected to a RJ-45 plug to transmit high-frequency data signals, crosstalks generated and reflected losses caused by impedance mismatches right at the mating area increase dramatically. Especially high NEXT and FEXT are produced for certain adjacent wire pairs therein. It all makes sense because the mated resilient pin 3 (tip) is closer to the mated resilient pin 4 (ring) than is to the mated resilient pin 5 (tip). Likewise, the mated resilient pin 6 (ring) is closer to the mated resilient pin 5 (tip) than is to the mated resilient pin 4 (ring)(FIG. 3). Consequently differential capacitive and inductive couplings occurs between the mated Pair 1 and Pair 3 that generate hugely both NEXT and FEXT.

A RJ-45 jack that is configured to suppress or to compensate for crosstalk introduced by a mating RJ-45 plug, is generally known. The way to relieve crosstalk problem is conceptually performed by employing capacitive and inductive couplings equal to and opposite to the noise signals such that the induced noise signals are effectively cancelled by the induced correction signals. This implementation is referred to as "compensation". In other words, if electromagnetic compensation inside a modular jack is in opposite polarity and substantially equal in magnitude to a modular plug, a balanced differential signal transmission can be achieved.

Referring to FIG. 4, the NEXT vector of a RJ-45 standard specified plug derived from standard specified method is demonstrated. Obviously, Pair 1 and Pair 3 have to be capacitively and inductively compensated the most so as to enable desirable balanced transmission.

Accordingly, it is imperative to provide a pin structure of a modular jack to reduce crosstalk and loss and thereby meet strict standards.

SUMMARY OF THE INVENTION

In view of the aforesaid drawbacks of the prior art, the inventor of the present invention conceived room for improvement in the prior art and thus conducted extensive researches, and finally developed a pin structure of a modular jack to reduce crosstalk and loss so as to meet stricter requirements.

In order to achieve the above and other objectives, the present invention provides a pin structure of a modular jack. The pin structure of a modular jack comprises: a first resilient pin, a second resilient pin, a third resilient pin, a fourth resilient pin, a fifth resilient pin, a sixth resilient pin, a seventh resilient pin and an eighth resilient pin, wherein a bent electrically fixing portion and a bent electrical contact portion are disposed at two ends of each of the first through eighth resilient pins, respectively, wherein the first through eighth resilient pins are arranged in sequence and parallel to each other, wherein all the bent electrically fixing portions are fixed to a circuit board, wherein vertices of all the bent electrical contact portions point away from the circuit board, wherein the bent electrically fixing portions of the first resilient pin, the second resilient pin, the fourth resilient pin and the sixth resilient pin lie on a first straight line, wherein the bent electrically fixing portions of the third resilient pin, the fifth resilient pin, the seventh resilient pin and the eighth resilient pin lie on a second straight line, wherein the vertices of all the bent electrical contact portions lie on a third straight line, with the second straight line positioned proximate to the insertion side of the circuit board, the first straight line positioned distal to the insertion side of the circuit board, and the third straight line disposed between the first straight line and the second straight line.

In the pin structure of a modular jack, a bend portion is disposed between two ends of each of the resilient pins, wherein vertices of the bend portions of the first resilient pin, the third resilient pin, the fourth resilient pin, the fifth resilient pin, the sixth resilient pin and the eighth resilient pin point toward the circuit board, and vertices of the bend portions of the second resilient pin and the seventh resilient pin point away from the circuit board, wherein the bend portions of the second resilient pin and the seventh resilient pin are higher than the bend portions of the first resilient pin, the third resilient pin, the fourth resilient pin, the fifth resilient pin, the sixth resilient pin and the eighth resilient pin.

In the pin structure of a modular jack, each of the bent electrically fixing portions of the first resilient pin, the third resilient pin and the fifth resilient pin is L-shaped and has a vertex pointing away from a lateral side of the circuit board, wherein each of the bent electrically fixing portions of the fourth resilient pin, the sixth resilient pin and the eighth resilient pin is L-shaped and has a vertex pointing away from an opposing lateral side of the circuit board.

Therefore, the pin structure of a modular jack according to the present invention reduces crosstalk and loss so as to meet stricter requirements.

BRIEF DESCRIPTION OF THE DRAWINGS

Objectives, features, and advantages of the present invention are hereunder illustrated with specific embodiments in conjunction with the accompanying drawings, in which.

DETAILED DESCRIPTION OF THE PREFERRED EMBODIMENTS

Figure 11:
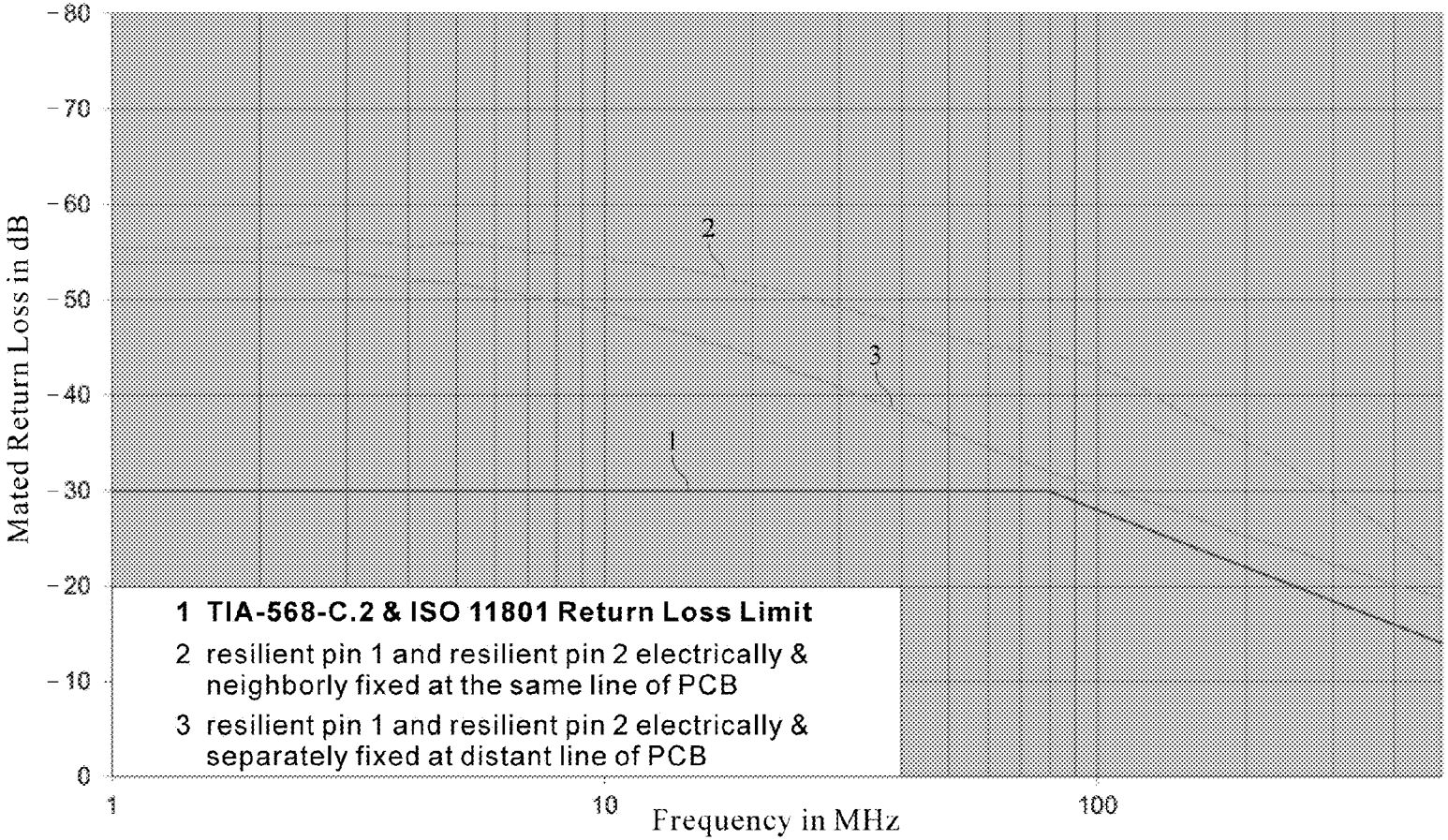
FIG. 11 is a graph of mated pair 2 return loss magnitude against frequency according to a preferred embodiment of the present invention.
Figure 12:
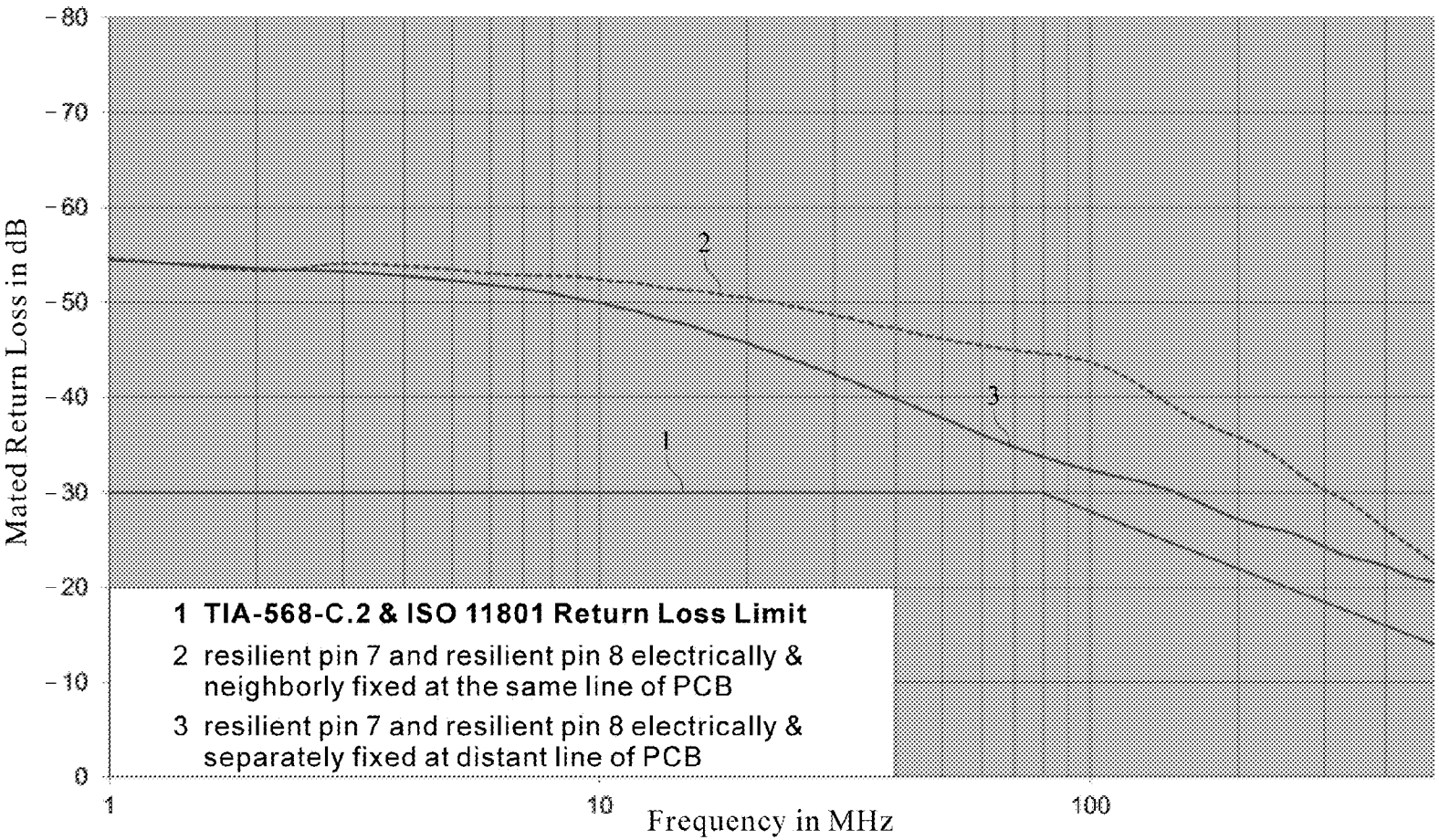
FIG. 12 is a graph of mated pair 4 return loss magnitude against frequency according to a preferred embodiment of the present invention.
Figure 13:
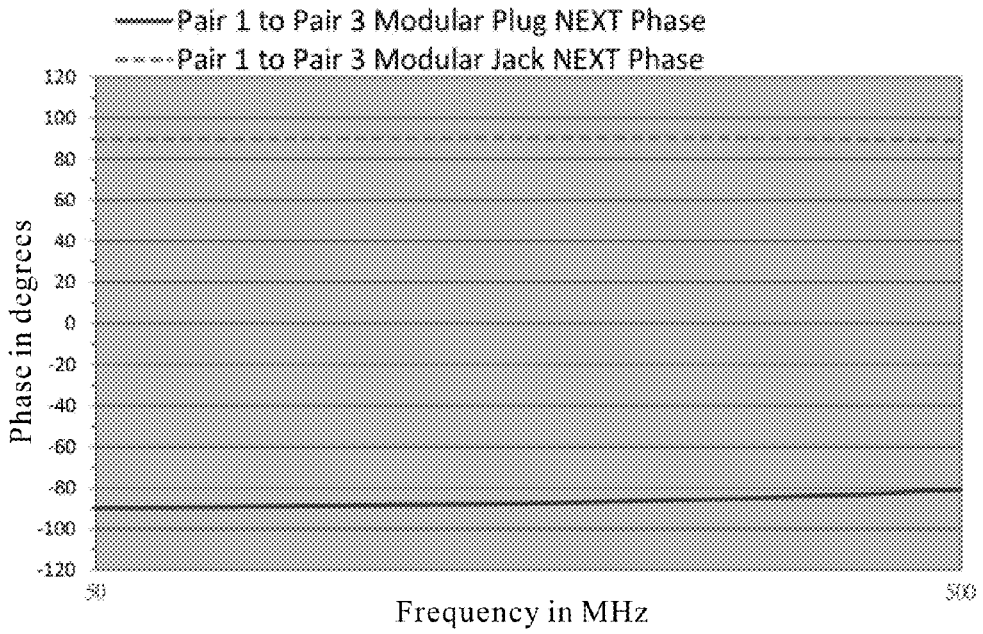
FIG. 13 is a graph of NEXT of a third differential pair relative to a first differential pair of the plug and jack according to a preferred embodiment of the present invention.
Figure 13:
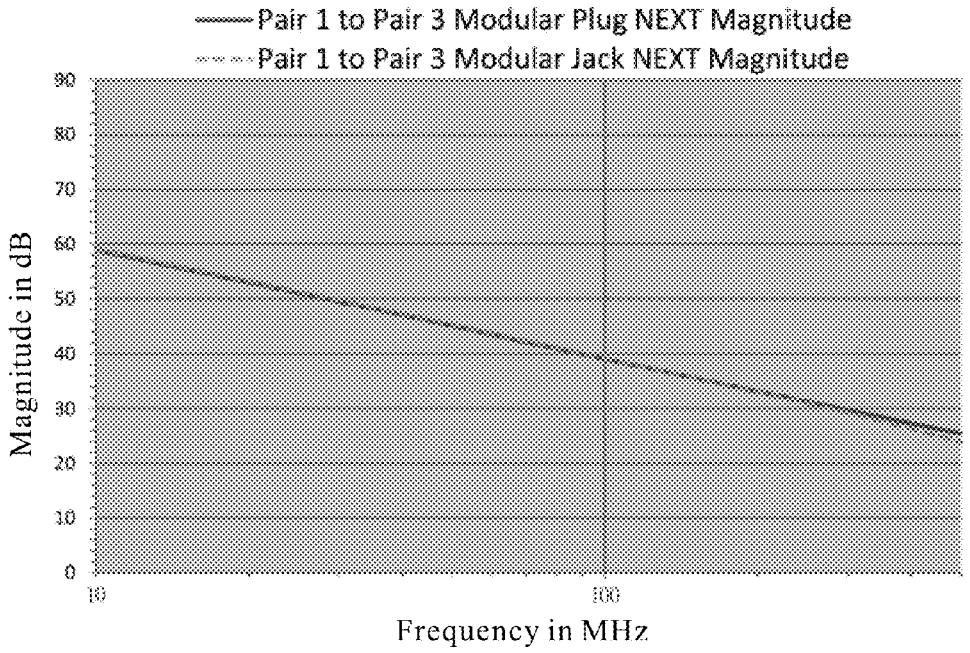
Figure 14:
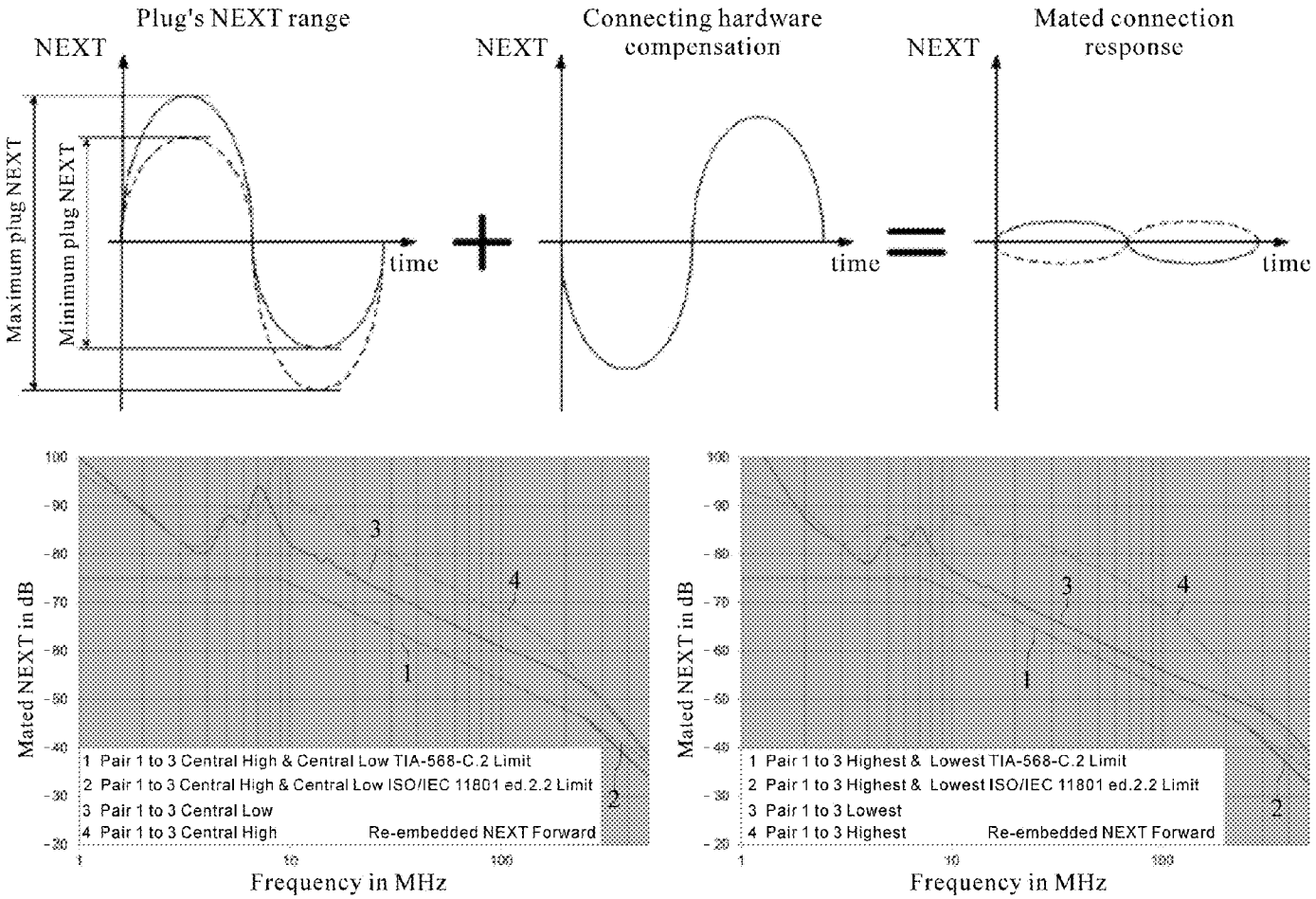
FIG. 14 is a graph of plug and jack mated NEXT of the third differential pair relative to the first differential pair according to a preferred embodiment of the present invention.

Referring to FIG. 5 through FIG. 9, the present invention provides a pin structure of a modular jack. The pin structure of a modular jack comprises a first resilient pin 1, a second resilient pin 2, a third resilient pin 3, a fourth resilient pin 4, a fifth resilient pin 5, a sixth resilient pin 6, a seventh resilient pin 7 and an eighth resilient pin 8. The numbers of the first resilient pin 1, the second resilient pin 2, the third resilient pin 3, the fourth resilient pin 4, the fifth resilient pin 5, the sixth resilient pin 6, the seventh resilient pin 7 and the eighth resilient pin 8 are the same as the numbers of resilient pins of a RJ-45 modular jack 101 and match the numbers of conductive plates of a RJ-45 modular plug 102 in a one-to-one manner; hence, when the modular plug 102 is plugged into the modular jack 101, the resilient pins of the modular jack 101 electrically connect with the conductive plates of the modular plug 102 according to their respective numbers, respectively. The fourth resilient pin 4 and the fifth resilient pin 5 together form a first differential pair. The first resilient pin 1 and the second resilient pin 2 together form a second differential pair. The third resilient pin 3 and the sixth resilient pin 6 together form a third differential pair. The seventh resilient pin 7 and the eighth resilient pin 8 together form a fourth differential pair. Bent electrically fixing portions 11, 21, 31, 41, 51, 61, 71, 81 and bent electrical contact portions 12, 22, 32, 42, 52, 62, 72, 82 are disposed at the two ends of the resilient pins 1, 2, 3, 4, 5, 6, 7, 8, respectively. The resilient pins 1, 2, 3, 4, 5, 6, 7, 8 are arranged in sequence and spaced apart and parallel to each other. All the bent electrically fixing portions 11, 21, 31, 41, 51, 61, 71, 81 are fixed to a circuit board 9. Each of the bent electrically fixing portions 11, 31, 41, 51, 61, 81 is formed by bending one end of a cantilever to attain an included angle 111, 311, 411, 511, 611, 811 of 100 degrees as needed. Each of the bent electrically fixing portions 21, 71 is formed by bending one end of a cantilever to attain an included angle 211, 711 of 135 degrees as needed. The aforesaid bending process draws the vertices 121, 221, 321, 421, 521, 621, 721, 821 of the bent electrical contact portions 12, 22, 32, 42, 52, 62, 72, 82 away from the top surface of the circuit board 9. Each of the bent electrical contact portions 12, 82 is formed by bending the other end of the cantilever to attain an included angle 122, 822 of 105 degrees as needed. Each of the bent electrical contact portions 22, 72 is formed by bending the other end of the cantilever to attain an included angle 222, 722 of 100 degrees as needed. Each of the bent electrical contact portions 32, 42, 52, 62 is formed by bending the other end of the cantilever to attain an included angle 322, 422, 522, 622 of 85 degrees as needed. The bent electrically fixing portions 11, 21, 41, 61 of the first resilient pin 1, the second resilient pin 2, the fourth resilient pin 4 and the sixth resilient pin 6 lie on a first straight line 96. The first straight line 96 is parallel to the insertion side 91 of the circuit board 9 (i.e., one side of the circuit board 9 facing the modular plug 102) and is positioned distal to the insertion side 91 of the circuit board 9. Referring to FIG. 11, when the first resilient pin 1 and the second resilient pin 2 lie on the first straight line 96, the first resilient pin 1 and the second resilient pin 2 can be coupled to each other and their impedance can match to therefore achieve better impedance control, avoid noise interference, and reduce return loss. The bent electrically fixing portions 31, 51, 71, 81 of the third resilient pin 3, the fifth resilient pin 5, the seventh resilient pin 7 and the eighth resilient pin 8 lie on a second straight line 97. The second straight line 97 is parallel to the insertion side 91 of the circuit board 9. The second straight line 97 is positioned proximate to the insertion side 91 of the circuit board 9. Referring to FIG. 12, when the seventh resilient pin 7 and the eighth resilient pin 8 lie on the second straight line 97, the seventh resilient pin 7 and the eighth resilient pin 8 can be coupled to each other and their impedance can match to therefore achieve better impedance control, avoid noise interference, and reduce return loss. Referring to FIG. 13 and FIG. 14, the magnitudes and phases of NEXT of the third differential pair relative to the first differential pair can be offset by compensation. With both the fourth resilient pin 4 and the sixth resilient pin 6 lying on the first straight line 96 as well as both the third resilient pin 3 and the fifth resilient pin 5 lying on the second straight line 97, so as to form a mutual coupling along the full parallel length, the modular plug 102 is plugged into the modular jack 101 to therefore allow their mutual electromagnetic coupling provides the shift polarity required for the aforesaid offset, that is, equal magnitudes and opposite phases. The vertices 121, 221, 321, 421, 521, 621, 721, 821 of all the bent electrical contact portions 12, 22, 32, 42, 52, 62, 72, 82 lie on a third straight line 98 so that all the vertices 121, 221, 321, 421, 521, 621, 721, 821 electrically connect with all the conductive plates of the modular plug 102. The third straight line 98 is parallel to the insertion side 91 of the circuit board 9. The third straight line 98 is disposed between the first straight line 96 and the second straight line 97. The third straight line 98 is higher than the first straight line 96 and the second straight line 97. Preferably, the first straight line 96 and the second straight line 97 are far away from each other as much as possible. The farther the first straight line 96 is from the second straight line 97, the less interference arises from the mutual capacitance and mutual inductance between the third resilient pin 3 and the fourth resilient pin 4, and the less interference arises from the mutual capacitance and mutual inductance between the fifth resilient pin 5 and the sixth resilient pin 6.

Figure 1:
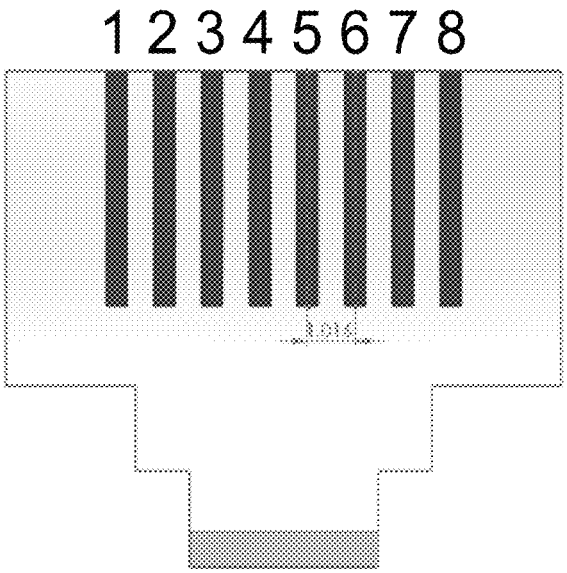
FIG. 1 (BACKGROUND ART)
FIG. 1 is a schematic view of a RJ-45 jack.
Figure 2:
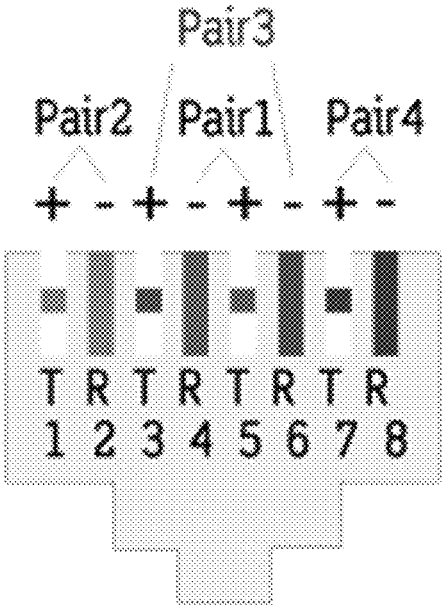
FIG. 2 (BACKGROUND ART)
FIG. 2 is a schematic view of a RJ-45 plug.
Figure 3:
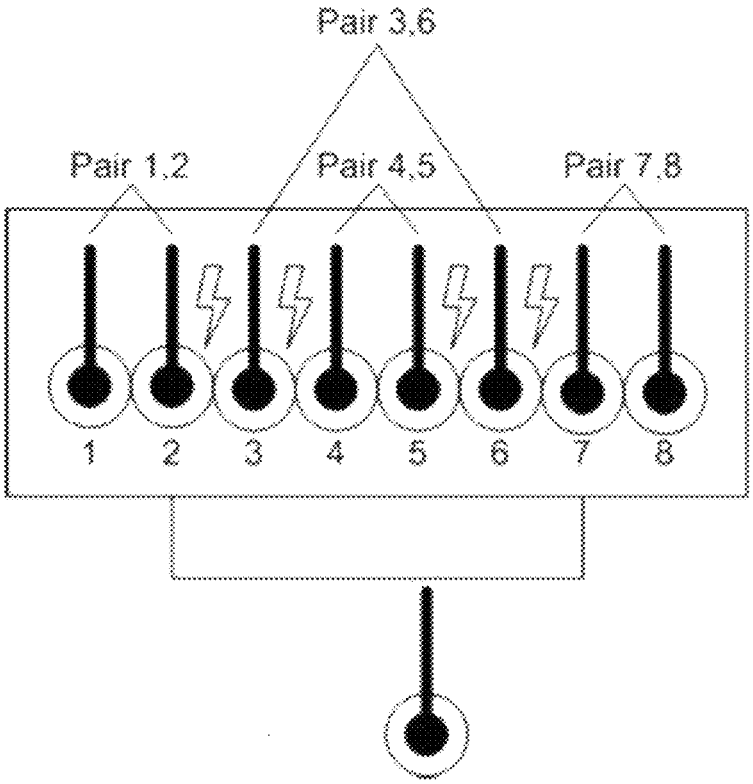
FIG. 3 (BACKGROUND ART)
FIG. 3 is a schematic view of the RJ-45 plug with crosstalk.
Figure 4:
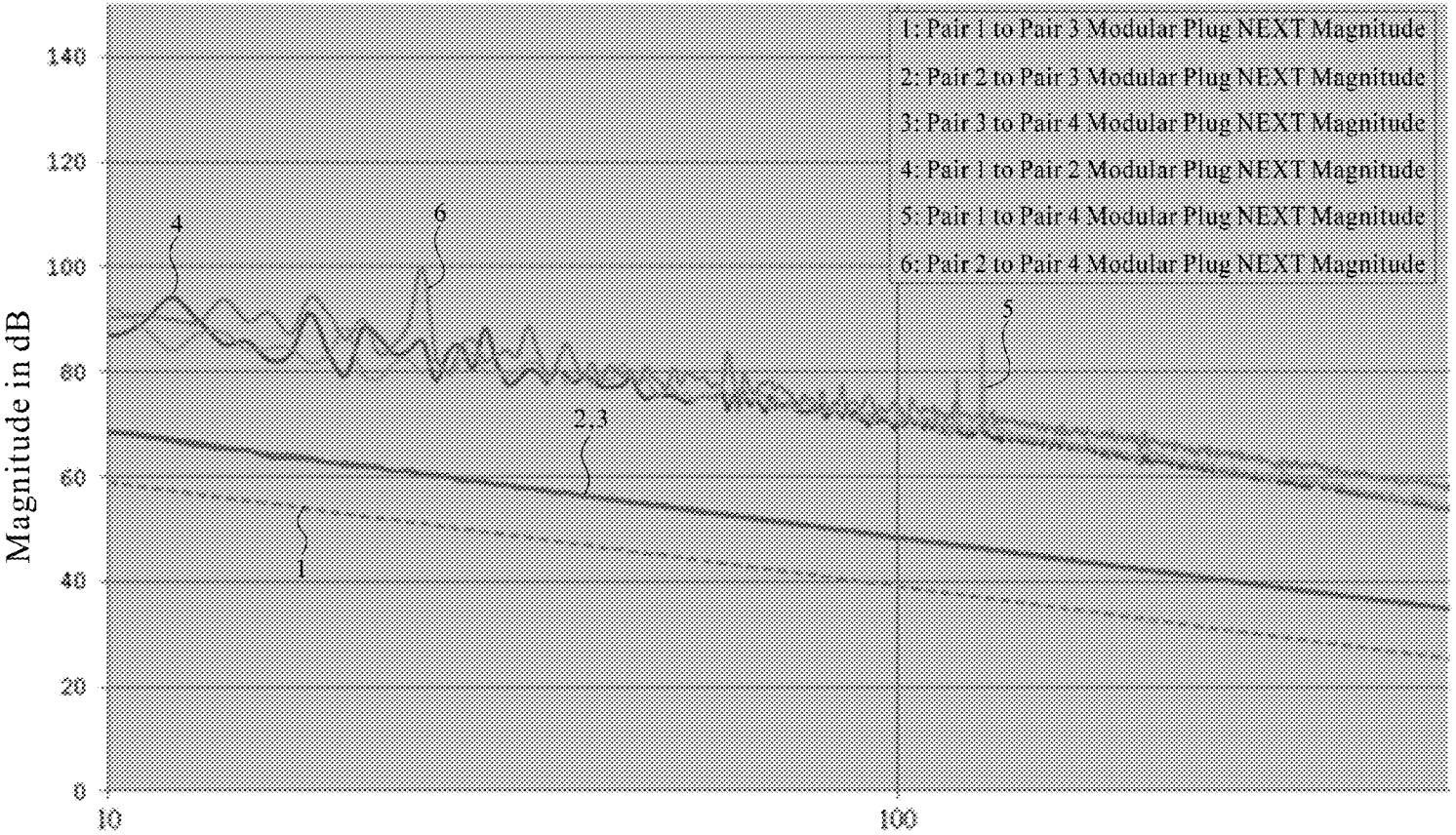
FIG. 4 (BACKGROUND ART)
FIG. 4 is a graph of typical standard specified NEXT magnitude of differential pairs of the qualified RJ-45 modular plug against frequency.
Figure 5:
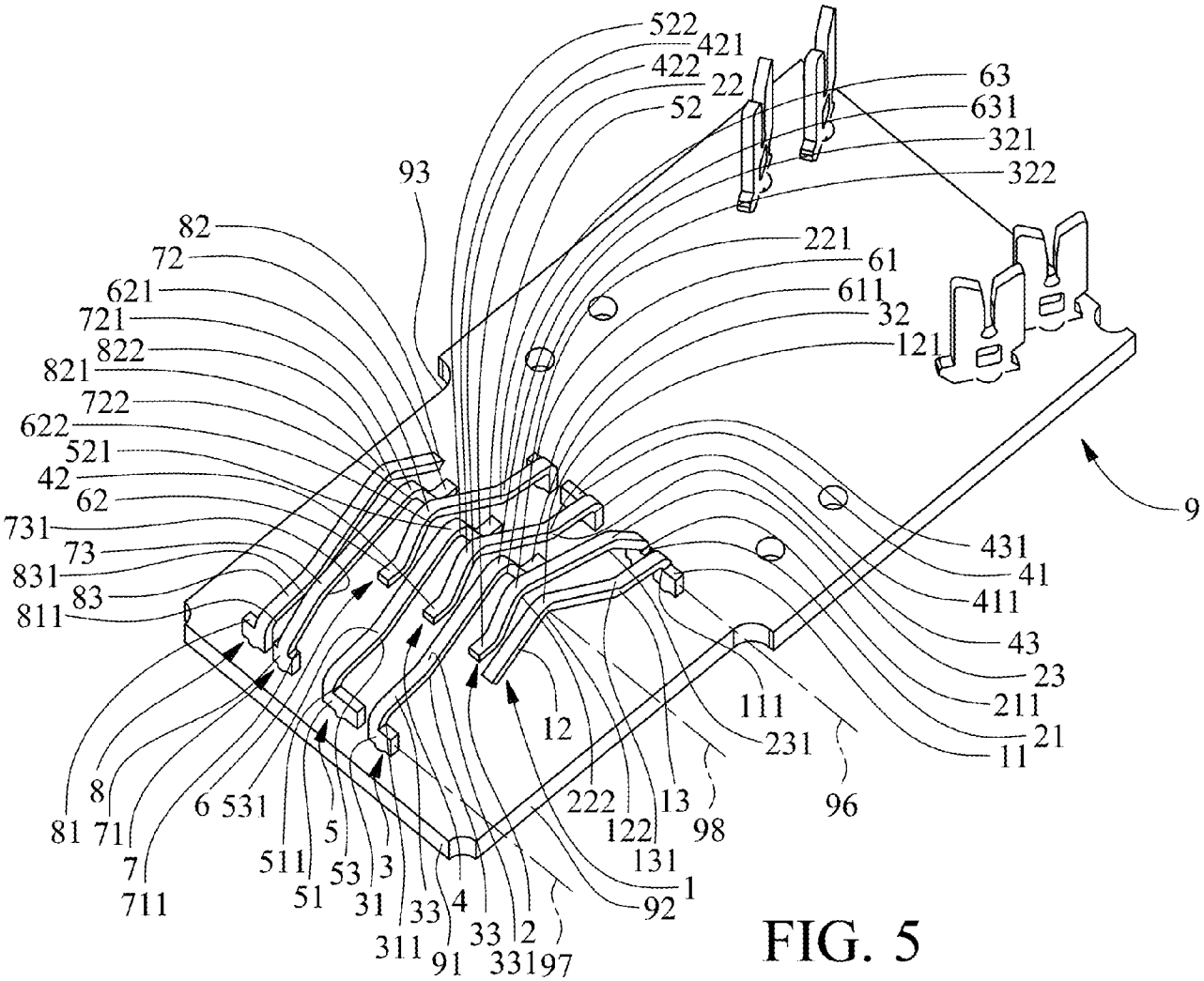
FIG. 5 is a schematic perspective view of a preferred embodiment of the present invention.
Figure 15:
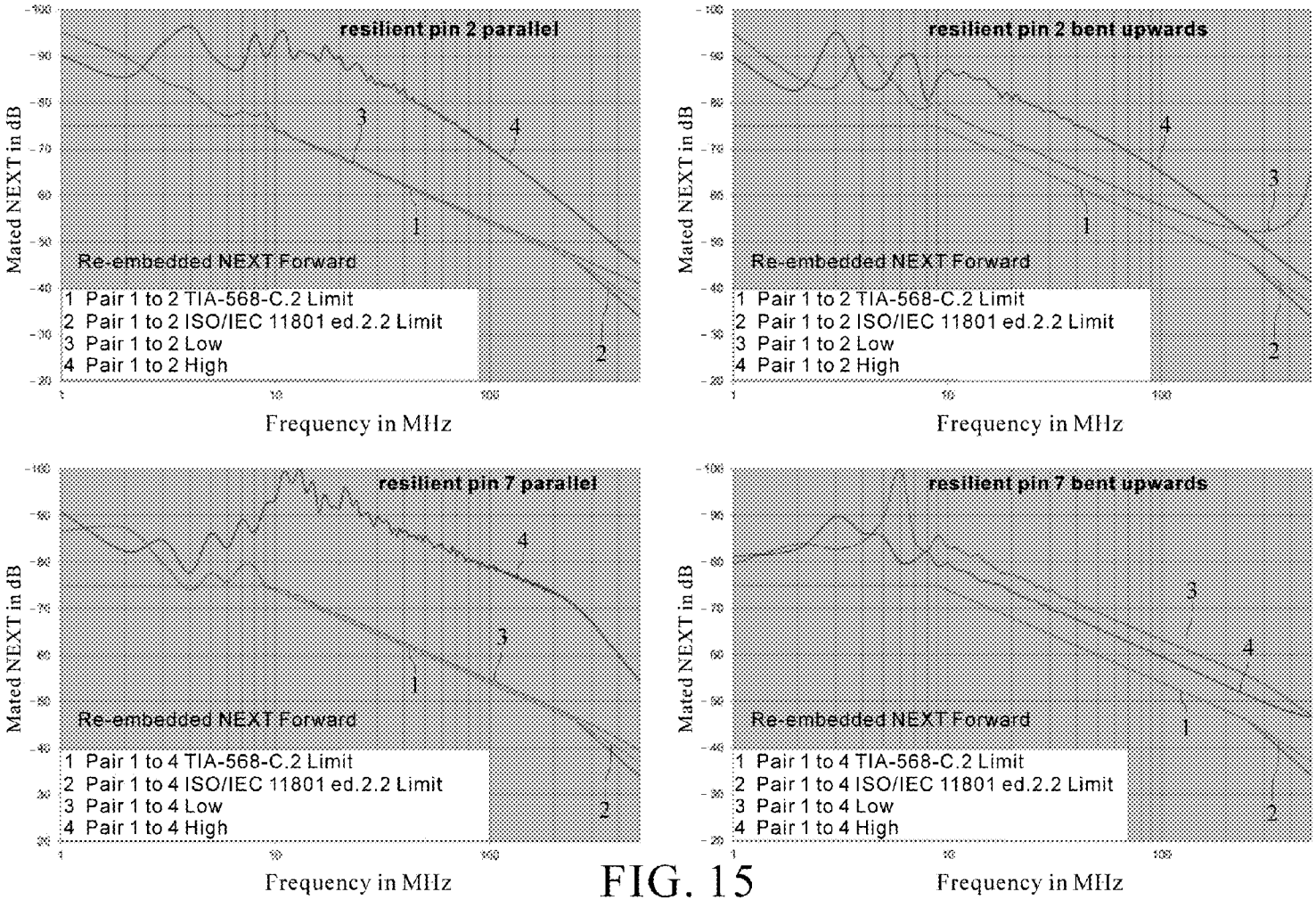
FIG. 15 is a comparison graph of plug and jack mated NEXT of the first differential pair relative to the second differential pair and a comparison graph of plug and jack mated NEXT of the first differential pair relative to the fourth differential pair according to a preferred embodiment of the present invention.

Referring to FIG. 5, in the pin structure of a modular jack, bend portions 13, 23, 33, 43, 53, 63, 73, 83 are disposed between the two ends of the resilient pins 1, 2, 3, 4, 5, 6, 7, 8, respectively. Each of the bend portions 13, 23, 33, 43, 53, 63, 73, 83 is formed by bending a portion between the two ends of the cantilever. Vertices of the bend portions 13, 33, 43, 53, 63, 83 of the first resilient pin 1, the third resilient pin 3, the fourth resilient pin 4, the fifth resilient pin 5, the sixth resilient pin 6 and the eighth resilient pin 8 point toward the top surface of the circuit board 9, wherein the included angle 131, 331, 431, 531, 631, 831 of the bend portions 13, 33, 43, 53, 63, 83 equals 155 degrees as needed. Vertices of the bend portions 23, 73 of the second resilient pin 2 and the seventh resilient pin 7 point away from the top surface of the circuit board 9, wherein the included angle 231, 731 of the bend portions 23, 73 equals 155 degrees as needed. The bend portions 23, 73 of the second resilient pin 2 and the seventh resilient pin 7 are higher than the bend portions 13, 33, 43, 53, 63, 83 of the first resilient pin 1, the third resilient pin 3, the fourth resilient pin 4, the fifth resilient pin 5, the sixth resilient pin 6 and the eighth resilient pin 8. The second resilient pin 2 and the seventh resilient pin 7 are substantially equal in shape. The first resilient pin 1, the third resilient pin 3, the fourth resilient pin 4, the fifth resilient pin 5, the sixth resilient pin 6 and the eighth resilient pin 8 are substantially equal in shape. Therefore, the parallel length of the second resilient pin 2 and the fourth resilient pin 4 decreases as the parallel length of the first resilient pin 1 and the fourth resilient pin 4 increases, whereas the parallel length of the fifth resilient pin 5 and the seventh resilient pin 7 decreases as the parallel length of the fifth resilient pin 5 and the eighth resilient pin 8 increases. Referring to FIG. 15, since the parallel length of the second resilient pin 2 and the fourth resilient pin 4 decreases, the coupling of the second resilient pin 2 and the fourth resilient pin 4 is minimized Since the parallel length of the fifth resilient pin 5 and the seventh resilient pin 7 decreases, the coupling of the fifth resilient pin 5 and the seventh resilient pin 7 is minimized Since the parallel length of the first resilient pin 1 and the fourth resilient pin 4 increases, the crosstalk between the second resilient pin 2 and the fourth resilient pin 4 is counteracted. Since the parallel length of the fifth resilient pin 5 and the eighth resilient pin 8 increases, the crosstalk between the fifth resilient pin 5 and the seventh resilient pin 7 is counteracted.

Figure 6:
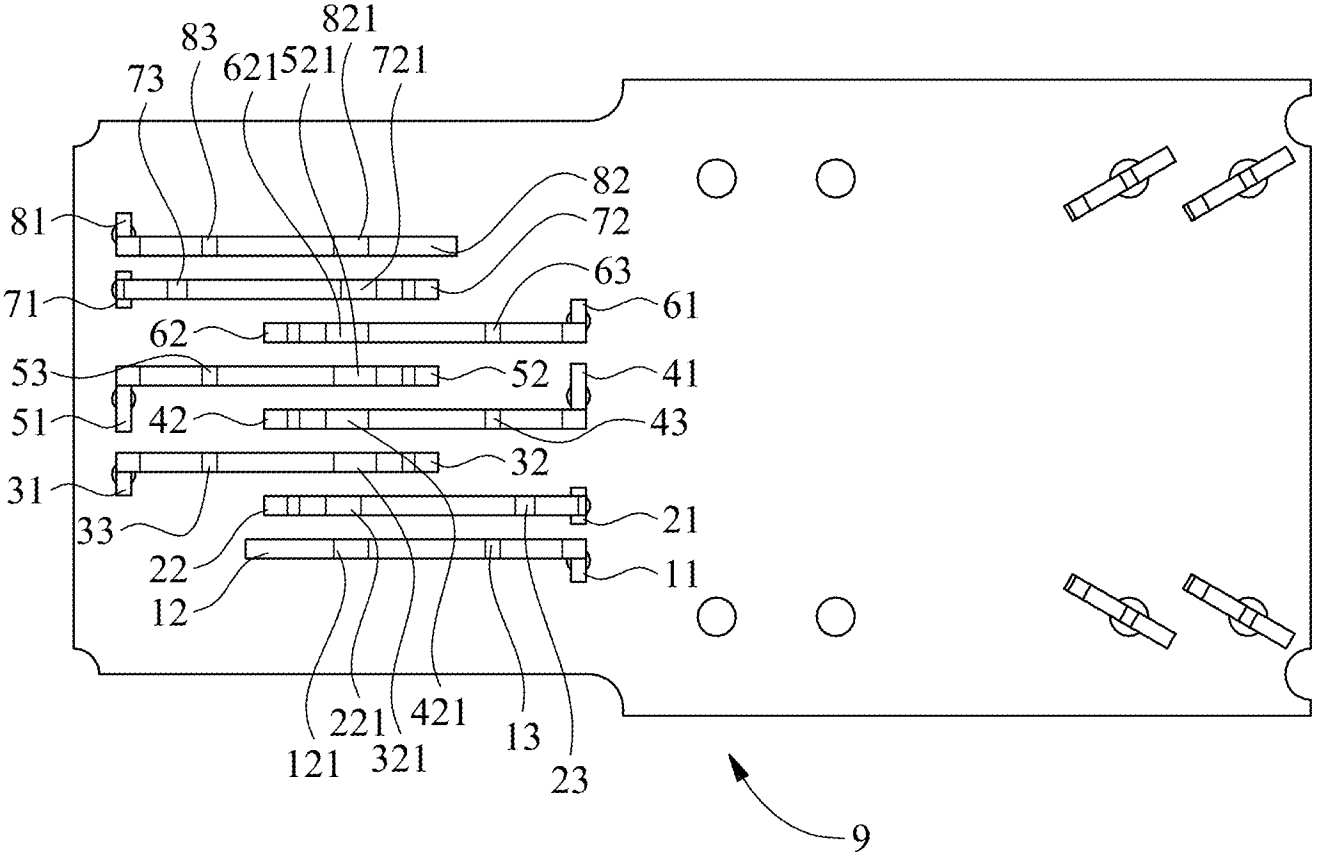
FIG. 6 is a schematic view of the upper side of FIG. 5.

Referring to FIG. 5 and FIG. 6, in the pin structure of a modular jack, each of the bent electrically fixing portions 11, 31, 51 of the first resilient pin 1, the third resilient pin 3 and the fifth resilient pin 5 is L-shaped, and the vertices of the bent electrically fixing portions 11, 31, 51 point away from a lateral side 92 (such as the right side) of the circuit board 9. Each of the bent electrically fixing portions 41, 61, 81 of the fourth resilient pin 4, the sixth resilient pin 6 and the eighth resilient pin 8 is L-shaped, and the vertices of the bent electrically fixing portions 41, 61, 81 point away from an opposing lateral side 93 (such as the left side) of the circuit board 9. Therefore, the aforesaid L-shaped structures are conducive to the adjustment of the fixed positions of all the bent electrically fixing portions 11, 21, 31, 41, 51, 61, 71, 81 of all the resilient pins 1, 2, 3, 4, 5, 6, 7, 8 relative to each other as well as the adjustment of the configured positions of all the bent electrical contact portions 12, 22, 32, 42, 52, 62, 72, 82 of all the resilient pins 1, 2, 3, 4, 5, 6, 7, 8 relative to each other, so as to optimize the configuration of all the resilient pins 1, 2, 3, 4, 5, 6, 7, 8.

Figure 7:
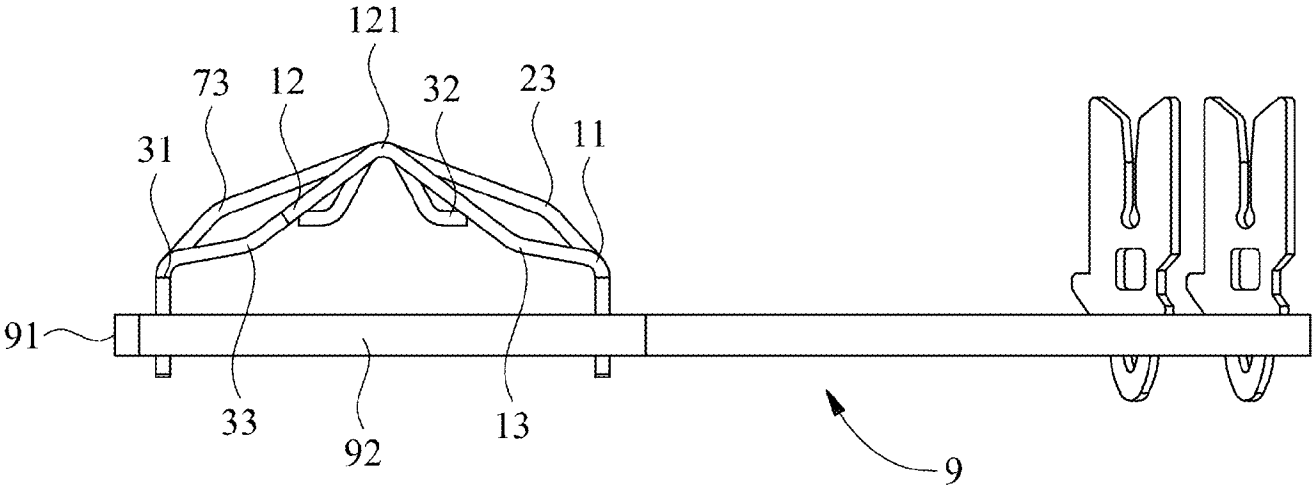
FIG. 7 is a schematic view of the right side of FIG. 5.
Figure 8:
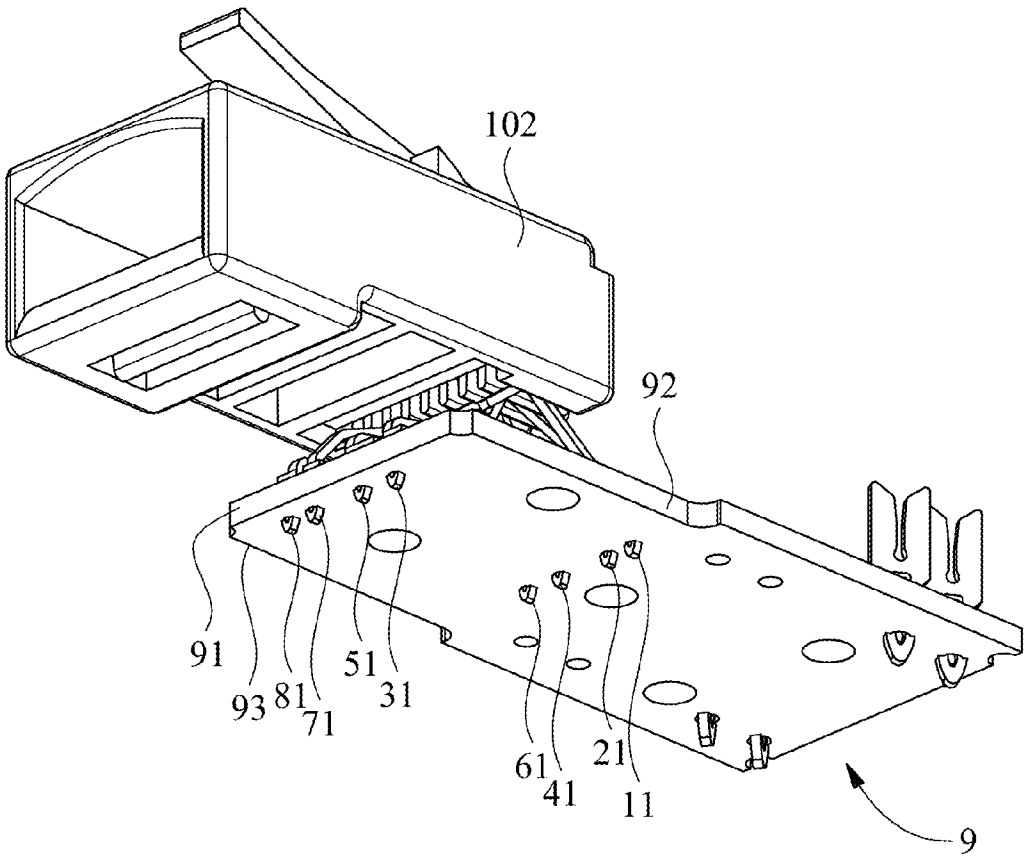
FIG. 8 is a schematic view of a preferred embodiment of the present invention and a plug connected.
Figure 9:
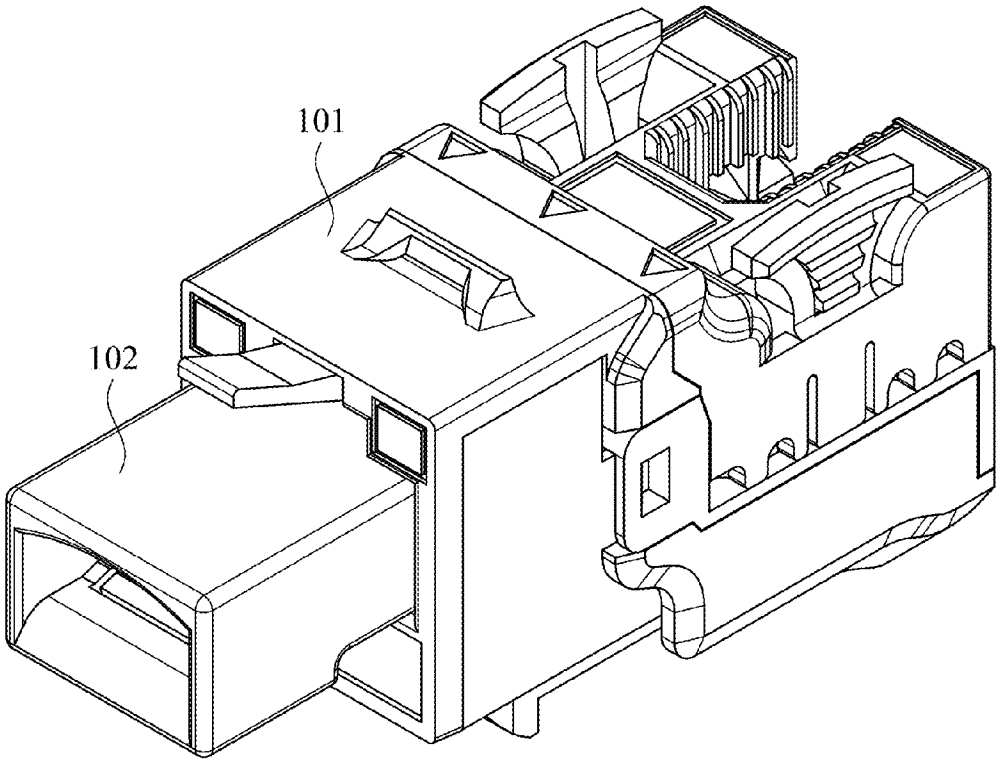
FIG. 9 is a schematic view of the connection of the plug and a jack according to a preferred embodiment of the present invention.
Figure 10:
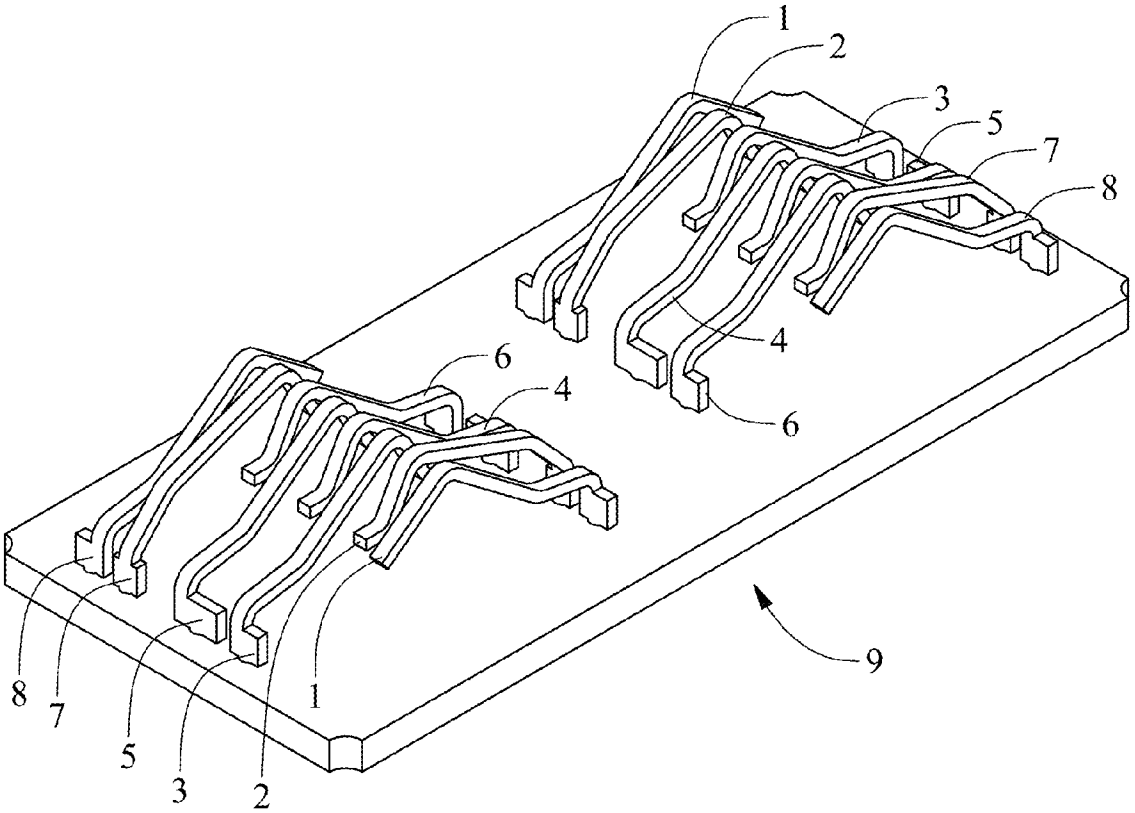
FIG. 10 is another schematic perspective view of a preferred embodiment of the present invention.

Referring to FIG. 5 through FIG. 7, the circuit board 9 is provided with a pin structure of a modular jack. Referring to FIG. 10, the circuit board 9 is provided with two pin structures of a modular jack by rotating horizontally the pin structure disposed on one side of the circuit board 9 by 180 degrees and then copying it to the other side of the circuit board 9. With the circuit board 9 being provided with the two pin structures, two plugs can be connected, thereby achieving feed-through connection.

The present invention is disclosed above by preferred embodiments. However, persons skilled in the art should understand that the preferred embodiments are illustrative of the present invention only, but should not be interpreted as restrictive of the scope of the present invention. Hence, all equivalent modifications and replacements made to the aforesaid embodiments should fall within the scope of the present invention. Accordingly, the legal protection for the present invention should be defined by the appended claims.

What is claimed is:

1. A pin structure of a modular jack, comprising: a first resilient pin, a second resilient pin, a third resilient pin, a fourth resilient pin, a fifth resilient pin, a sixth resilient pin, a seventh resilient pin and an eighth resilient pin, wherein a bent electrically fixing portion and a bent electrical contact portion are disposed at two ends of each of the first through eighth resilient pins, respectively, wherein the first through eighth resilient pins are arranged in sequence and parallel to each other, wherein all the bent electrically fixing portions are fixed to a circuit board, wherein vertices of all the bent electrical contact portions point away from the circuit board, wherein the bent electrically fixing portions of the first resilient pin, the second resilient pin, the fourth resilient pin and the sixth resilient pin lie on a first straight line, wherein the bent electrically fixing portions of the third resilient pin, the fifth resilient pin, the seventh resilient pin and the eighth resilient pin lie on a second straight line, wherein the vertices of all the bent electrical contact portions lie on a third straight line, with the second straight line positioned proximate to the insertion side of the circuit board, the first straight line positioned distal to the insertion side of the circuit board, and the third straight line disposed between the first straight line and the second straight line.

2. The pin structure of a modular jack of claim 1, wherein a bend portion is disposed between two ends of each of the resilient pins, wherein vertices of the bend portions the first resilient pin, the third resilient pin, the fourth resilient pin, the fifth resilient pin, the sixth resilient pin and the eighth resilient pin point toward the circuit board, and vertices of the bend portions of the second resilient pin and the seventh resilient pin point away from the circuit board, wherein the bend portions of the second resilient pin and the seventh resilient pin are higher than the bend portions of the first resilient pin, the third resilient pin, the fourth resilient pin, the fifth resilient pin, the sixth resilient pin and the eighth resilient pin.

3. The pin structure of a modular jack of claim 1, wherein each of the bent electrically fixing portions of the first resilient pin, the third resilient pin and the fifth resilient pin is L-shaped and has a vertex pointing away from a lateral side of the circuit board, wherein each of the bent electrically fixing portions of the fourth resilient pin, the sixth resilient pin and the eighth resilient pin is L-shaped and has a vertex pointing away from an opposing lateral side of the circuit board.

* * * * *